United States Patent [19]

Toole

[11] Patent Number: 4,779,993

[45] Date of Patent: Oct. 25, 1988

[54] OIL AND GASOLINE MIXING DEVICE

[76] Inventor: Ernest D. Toole, 270 Suncrest Blvd., Savannah, Ga. 31410

[21] Appl. No.: 919,375

[22] Filed: Oct. 16, 1986

[51] Int. Cl.[4] ..... B01F 15/02

[52] U.S. Cl. ..... 366/177; 141/105; 141/299; 141/331; 222/145; 366/341

[58] Field of Search ..... 366/150, 162, 177, 181, 366/341, 349; 222/145, 427, 48, 430, 510; 141/105, 299, 102, 100, 331-334; 220/86 R

[56] References Cited

U.S. PATENT DOCUMENTS

| | | |
|---|---|---|
| 200,149 | 2/1878 | Newman . |
| 221,137 | 10/1879 | Wright . |
| 281,727 | 7/1883 | Pratt . |
| 412,817 | 10/1889 | Willis . |
| 457,595 | 8/1891 | Stransburger . |
| 590,243 | 9/1897 | Smith . |
| 592,490 | 10/1897 | Fangel . |
| 868,394 | 10/1907 | Ash . |
| 994,949 | 6/1911 | Papendry . |
| 2,796,196 | 6/1957 | Ortner . |
| 2,902,062 | 9/1959 | Smekal . |
| 3,055,554 | 9/1962 | Wright . |
| 3,132,771 | 5/1964 | Truby . |
| 3,275,194 | 9/1966 | Moulder . |
| 3,537,623 | 11/1970 | Fisher . |
| 4,140,160 | 2/1979 | Glackin . |

FOREIGN PATENT DOCUMENTS

| | | | |
|---|---|---|---|
| 1542916 | 10/1967 | France . | |
| 22702 | of 1914 | United Kingdom | 141/331 |
| 215580 | 5/1924 | United Kingdom . | |

*Primary Examiner*—Timothy F. Simone
*Attorney, Agent, or Firm*—Arthur G. Yeager

[57] ABSTRACT

A device for adding oil to a flowing stream of gasoline which includes an oil funnel with a small suction passageway in the apex of the funnel communicating with the interior of a gasoline feed pipe rigidly attached to the outside of the funnel, the pipe having a socket at its upper end to receive the nozzle of a gasoline pump hose and having a lower outlet end adapted to be placed in the fill pipe of a gasoline tank.

16 Claims, 1 Drawing Sheet

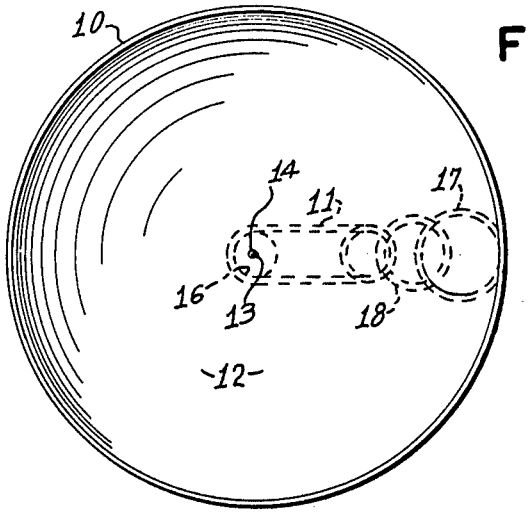
FIG. 1
FIG. 2
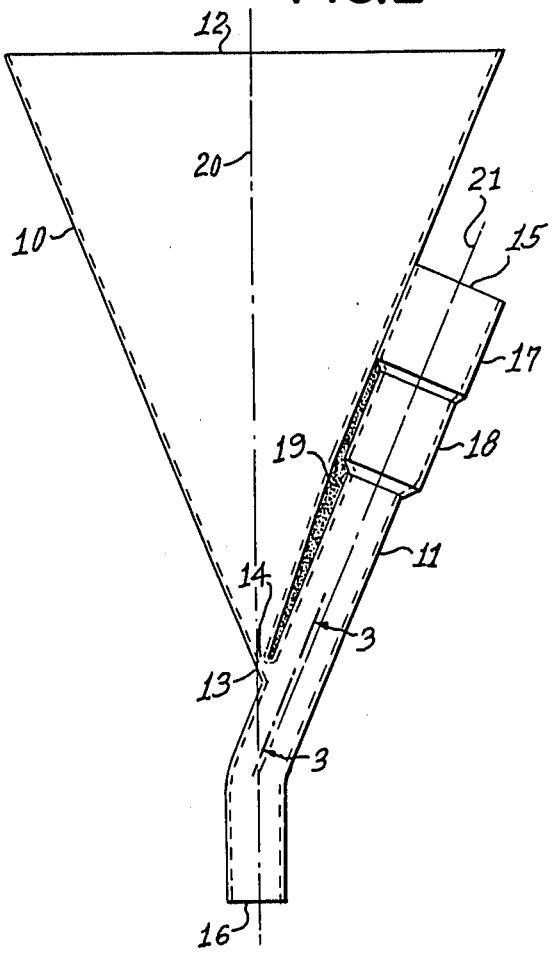
FIG. 3
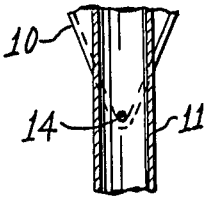

OIL AND GASOLINE MIXING DEVICE

BACKGROUND OF THE INVENTION

Gasoline engines for some purposes, e.g., marine engines, employ a fuel which is a mixture of gasoline and oil. It is not preferred to separately add oil and gasoline to the fuel tank because the mixing of the two components is not properly accomplished by this procedure. Accordingly, there has been a need for a device to add oil to gasoline in accurate proportions and in a well mixed manner.

It is an object of this invention to provide a device for intimately mixing oil and gasoline in accurate amounts. It is another object of this invention to provide such a device which can be used with the commercial gasoline pumps of today. Still other objects will become apparent from the more detailed description which follows.

BRIEF SUMMARY OF THE INVENTION

This invention relates to a gasoline and oil mixing device comprising a tubular conductor with an inlet end and an outlet end, said inlet end including a socket for receiving the nozzle of a gasoline pump hose, said outlet end being open and adapted to be placed in the fill pipe of a fuel tank, and funnel attached to said conductor with its large open end facing upwardly and a small outlet port at the apex communicating with the inside of said conductor adjacent said outlet end, said funnel being positioned such that the axis of said funnel is substantially vertical when the outlet end of said conductor is placed in said fill pipe.

In a specifically preferred embodiment of the invention the tubular upper end of the conductor includes two sockets placed in tandem, to receive either of two sizes of nozzles for pumps delivering leaded gasoline or unleaded gasoline.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 1 is a top plan view of the device of this invention;

FIG. 2 is a front elevational view of the device of this invention; and

FIG. 3 is a cross sectional view taken at 3—3 of FIG. 2.

DETAILED DESCRIPTION OF THE INVENTION

Reference to the attached drawings will permit an understanding of the features of this invention. An oil funnel 10 is attached to a gasoline pipe conductor 11 with a small passageway or port 14 connecting the apex 13 of funnel 10 to the inside of pipe 11. Upper end 15 of pipe 11 is formed with a socket 17 or 18 to receive the nozzle of a gasoline pump hose. In FIG. 2 there is shown the preferred embodiment of having two sockets 17 and 18 in tandem. Socket 17 is larger in diameter and is adapted to receive the nozzle of hose delivering leaded gasoline. Socket 18 is smaller in diameter and is adapted to receive the nozzle of hose delivering unleaded gasoline. Lower end 16 of pipe 11 is of any convenient size to be placed in the fill pipe of a fuel tank.

Funnel 10 is of any convenient size with the large open end 12 facing upwardly and the apex 13 facing downwardly. Funnel 10 may be conical in shape or pyramidal with 3 or 4 or more flat faces. Funnel 10 may be marked with volumetric measurements to assist in providing the proper proportion of oil. When lower end 16 of pipe 11 is placed in the fill pipe of a fuel tank, funnel 10 should be generally upright with open end 12 substantially horizontal so as not to spill oil from funnel 10.

Port 14 may be any convenient size, although the smaller the size the better the mixing in the gasoline in pipe 11. Too small a size, of course, would make it too time consuming to empty the oll from funnel 10. It is preferred for port 14 to be a suction port of about 0.1 to 0.2 inch in diameter, conveniently about 0.125 inch. The flow of gasoline past port 14 will assist the flow of oil through port 14 because of the aspiration effect.

It is preferred that pipe 11 be rigidly attached to funnel 10 in the position shown, i.e., tangentially along the outside surface of funnel 10 with axis 20 of funnel 10 and axis 21 of pipe 11 lying in a single plane. The means of attachment of funnel 10 to pipe 11 may be any convenient means, e.g., welding or soldering in the zone 19.

Funnel 10 and pipe 11 may be made of metal, e.g., aluminum or steel, or plastic, e.g., polyolefin, polyamide, polyvinyl, polyester, polyacetal, polycarbonate, or the like.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A gasoline and oil mixing device comprising a gasoline tubular conductor with an inlet end and an outlet end, said inlet end including a socket for receiving a nozzle of a gasoline pump hose, said outlet end being open and adapted to be placed in a fill pipe of a fuel tank, and an oil funnel attached to said conductor with its large open end facing upwardly and a small suction oil outlet port substantially smaller than the cross-section of said tubular conductor at the apex communicating with the inside of said conductor adjacent said outlet end through which oil is aspirated by the flow of gasoline through said conductor and generally uniformly entrained in the flow of gasoline passing through said conductor, said funnel being positioned such that the axis of said funnel is substantially vertical when the outlet end of said conductor is placed in a fill pipe of a fuel tank.

2. The device of claim 1 wherein said conductor includes two sockets at said inlet end, one socket to receive a nozzle for a hose delivering leaded gasoline and the other socket to receive a nozzle for a hose delivering unleaded gasoline.

3. The device of claim 2 wherein said two sockets are mounted serially and concentrically on said conductor adjacent said inlet end.

4. A gasoline and oil mixing device comprising an oil feed funnel rigidly attached to and communicating with a gasoline feed pipe by means of a small suction passageway leading from the apex of said funnel to the inside of said pipe, said funnel adapted to receive oil and feed that oil by gravity and by being aspirated by the flow of gasoline through said pipe through said suction passageway and generally uniformly entrain that oil in that gasoline passing through said pipe, said pipe having an upper end adapted to receive the nozzle of a gasoline pump hose and a lower end adapted to be placed in the fill pipe of a gasoline tank.

5. The device of claim 4 wherein said upper end of said pipe includes two sockets in tandem positions, the first socket at the extreme upper end being larger in diameter than the adjoining second socket, said sockets being adapted to receive respectively different size nozzles of pump hose delivering different types of gasoline.

6. A gasoline and oil mixing device comprising an elogated tubular gasoline conductor having an elongated passageway with opposing inlet and outlet ends, said inlet end including a socket for selectively receiving a nozzle of a gasoline pump hose, said outlet end being open and adapted to be placed in a fill opening of a fuel tank, and an elongated oil funnel having a large open end portion and an opposite small end portion, said small end portion being attached to said conductor adjacent said outlet end with said large open end portion facing upwardly, said small end portion having a small suction outlet port substantially smaller than the cross-section of said passageway communicating between said funnel and said passageway adjacent said outlet end, said outlet portion sucking oil from said funnel into said conductor by aspiration caused by the flow of gasoline to generally uniformly blend oil with gasoline flowing through said conductor.

7. The device of claim 6 wherein said passageway includes a first longitudinal axis which extends from said inlet end to adjacently between said outlet port and said outlet end, said funnel having a second longitudinal axis which is adapted to be substantially vertical when said outlet end is placed in a fill opening of a fuel tank, said first and second axes substantially intersecting between said outlet port and said outlet end.

8. The device of claim 7 wherein said second longitudinal axis passes through said outlet end and substantially defines the axis of said passageay from said intersecting defines the axis of said passageway from said intersecting axes outwardly through said outlet end.

9. The device of claim 8 wherein said outlet port is located between said first and second axes.

10. The device of claim 1 wherein said conductor includes two substantially aligned sockets at said inlet end, said socket being outwardly disposed and enlarged to receive a nozzle of a hose delivering leaded gasoline and the other said socket being inwardly disposed and reduced to receive a nozzle of a hose delivering unleaded gasoline.

11. The device of claim 10 wherein said passageway extends through said aligned sockets, each said socket having shoulder means adjacent their respective innermost ends against which nozzles of gasoline pump hoses are adapted to engage and be stopped thereby.

12. The device of claim 10 wherein said funnel is adapted to feed oil aspirated into the gasoline through said outlet port to provide a substantial uniform blend of oil and gasoline in a fuel tank.

13. A gasoline and oil mixing device comprising an elongated oil feed funnel having an outside surface, an elongated gasoline feed pipe having an outside surface, attachment means for rigidly affixing said pipe outside surface to said funnel outside surface, a small suction passageway being substantially smaller than the cross-section of said feed pipe leading from the apex of said funnel to the inside surface of said pipe, said funnel being adapted to receive oil and cause that oil to be aspirated through said passageway into said pipe by gasoline flowing through said pipe so that the oil is uniformly mixed with gasoline flowing through said pipe, said pipe having an upper end adapted to receive a nozzle of a gasoline pump hose and a lower end adapted to be placed in a fill opening of a gasoline tank.

14. The device of claim 13 wherein said upper end of said pipe includes two sockets in tandem positions, the first socket at the extreme upper end being larger in diameter than the adjoining second socket, said sockets being adapted to receive respectively different size nozzles of pump hoses delivering different types of gasoline.

15. The device of claim 13 wherein said pipe includes a first longitudinal axis which extends from its inlet end to below said passageway, said funnel having a second longitudinal axis which is adapted to be substantially vertical when the outlet end of said pipe is placed in a fill opening of a gasoline tank, said first and second axes substantially intersecting between said passageway and said outlet end.

16. The device of claim 15 wherein said second longitudinal axis passes through said outlet end and substantially defines the axis of said passageway from said intersecting axes outwardly through said outlet end.

* * * * *